United States Patent [19]

McAuliffe

[11] Patent Number: 4,913,419

[45] Date of Patent: Apr. 3, 1990

[54] STRIKING APPARATUS WITH VARIABLY RESISTANT RESILIENT JOINT

[76] Inventor: Patrick McAuliffe, 2350 S. Filbert St., Allentown, Pa. 18103

[21] Appl. No.: 292,893

[22] Filed: Jan. 3, 1989

[51] Int. Cl.[4] ..... A63B 69/00

[52] U.S. Cl. ..... 272/76

[58] Field of Search ..... 272/76, 77, 78, 141, 272/142, 135; 16/DIG. 13, DIG. 33, 277, 225, 227, 232

[56] References Cited

U.S. PATENT DOCUMENTS

| | | | |
|---|---|---|---|
| 3,916,480 | 11/1975 | Smith | 16/DIG. 13 |
| 4,175,315 | 11/1979 | Hayes et al. | 16/DIG. 13 |
| 4,309,029 | 1/1982 | Tomko | 272/76 |
| 4,491,316 | 1/1985 | Prince | 272/76 |
| 4,492,375 | 1/1985 | Connelly | 272/142 |
| 4,572,504 | 2/1986 | DiBartolo | 272/76 |
| 4,662,630 | 5/1987 | Dignard | 272/76 |
| 4,749,184 | 6/1988 | Tobin | 272/76 |

OTHER PUBLICATIONS

*Black Belt,* Jan. 1976, p. 18.

*Primary Examiner*—Stephen R. Crow
*Attorney, Agent, or Firm*—Steele, Gould & Fried

[57] ABSTRACT

A striking apparatus includes a resilient joint between a support and a strike receiving target. The hinge member has two resilient leaves joined to each other and retaining the target therebetween. A set of central stiffeners on the hinge leaves defines the preferential hinge axis. The apparatus includes a base section with a support arm which is attachable through a bracket to a vertical support. Posts extending perpendicular to planar plates defining the support and the target carry changeable dampers in the form of bands, O-rings or flexible rods, for user selection of target resistance.

9 Claims, 2 Drawing Sheets

FIG 1
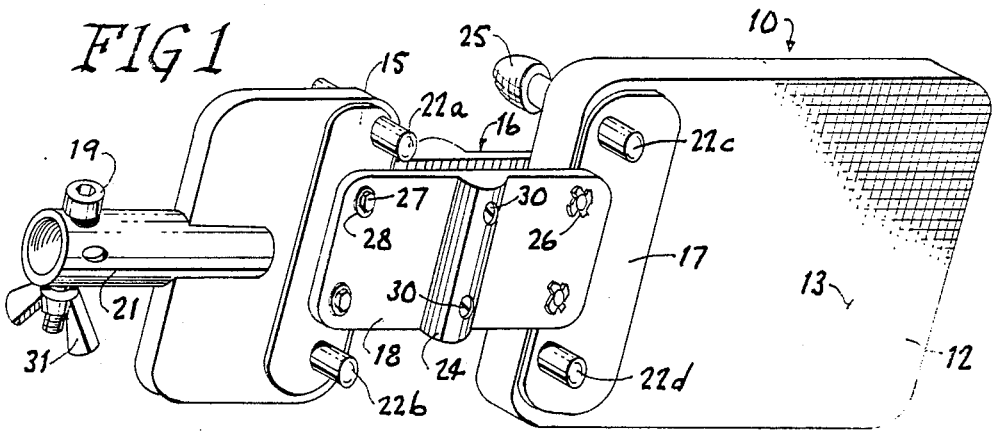
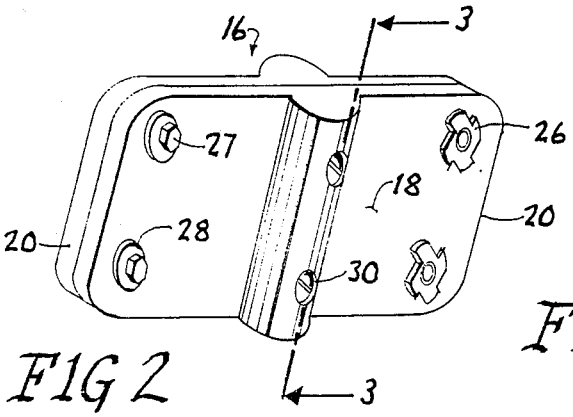
FIG 2
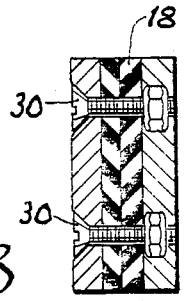
FIG 3
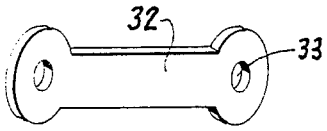
FIG 4a
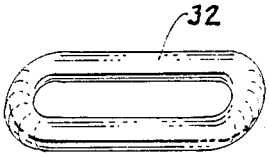
FIG 4b
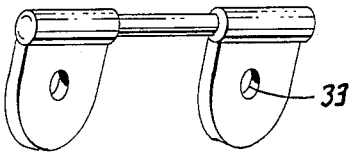
FIG 4c
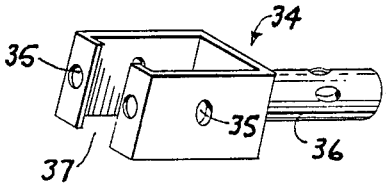
FIG 5

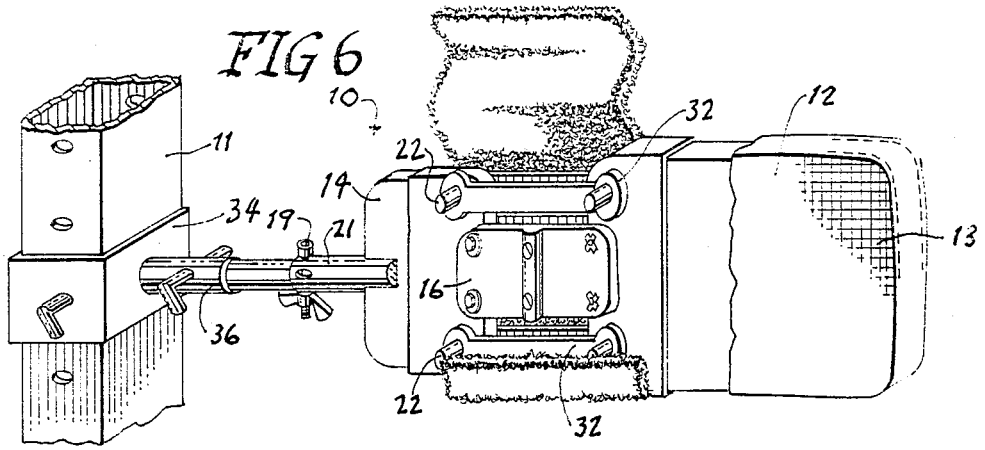
FIG 6
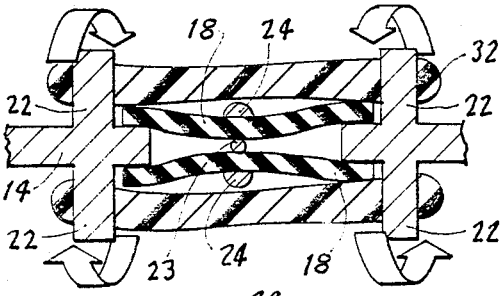
FIG 7a
FIG 7c
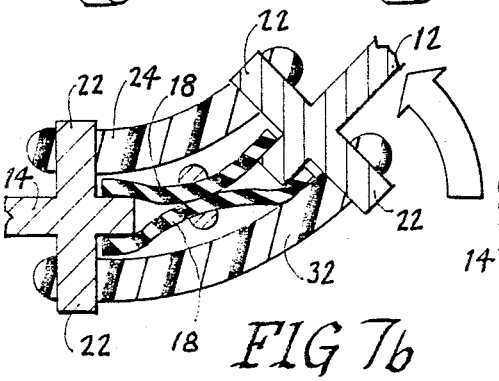
FIG 7b
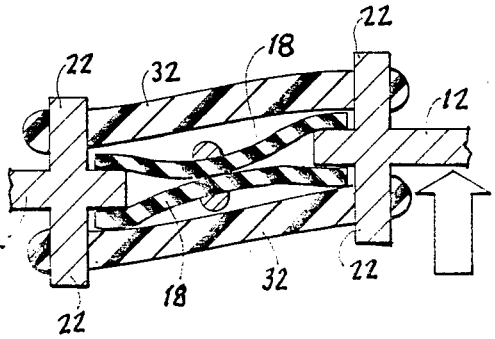
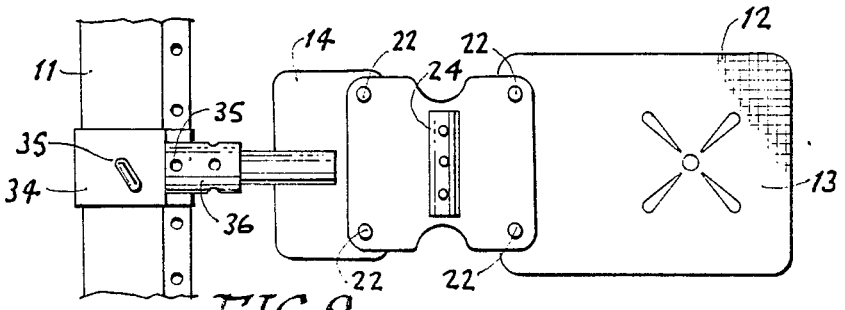
FIG 8

STRIKING APPARATUS WITH VARIABLY RESISTANT RESILIENT JOINT

BACKGROUND OF THE INVENTION

1. Field of the Invention

This invention relates to athletic practice equipment, and more particularly to a target apparatus to be struck in the practice of the martial arts, the strike receiving target held to a support by a resilient joint, allowing a certain displacement of connected parts.

2. Description of the Prior Art

The study of the martial arts has grown rapidly in the past years. There are many participants of varying ages and having varying degrees of both skill and strength. As a practitioner of the martial arts gets stronger and more accurate, the equipment on which he practices must withstand greater forces and still provide challenge.

Various striking devices for training in martial arts are known, and among them are stands and holders for panels, both breakable and non-breakable boards, which are kicked or struck by the user's hand or the like. U.S. Pat. No. 4,309,029 to Tomko discloses a striking device for martial arts training in which two spring leaf supports at different heights permit target pads to be resiliently attached to each other and include adjustable spacers to control tension. The height of the target is fixed and the apparatus is fastened to the ground or floor at two points. While Tomko's tension is adjustable, motion of the target is limited to pivoting. U.S. Pat. No. 4,491,316 to Prince discloses an apparatus for practicing defensive arts which includes a base, a vertical post and a universal support bracket for supporting articles, which are to be struck by the user, on the post. The articles are fitted with brackets which then interlock with brackets on the post itself. U.S. Pat. No. 4,572,504 to DiBartolo discloses a holder for a breakable karate board. The holder includes upper and lower spaced-apart horizontal frame members attached to a common vertical member and which hold a board vertically between them. The entire frame is attached directly to a wall or to a support stand. Similar to that arrangement is the "Power Fist" Board Holder which comprises two adjustable generally L-shaped sets of telescoping brackets which are fastened to a wall or set on the floor and hold a breakable board between them.

The objective of target panel practice is to apply maximum force to the panel. The user attempts to strike through the plane of the panel for maximum force. Breakable boards of course separate. Unbreakable apparatus (i.e., re-usable without re-assembly) must yield by displacement.

U.S. Pat. No. 4,749,184 to Tobin discloses a kicking practice apparatus which includes an impact-receiving member cantilevered outwardly from a tubular upright support member by a pivotable sleeve. Sets of resiliently yieldable springs and elastic cords extend in opposite directions around the sleeve to spaced posts to restore the position of the impact-receiving member after the sleeve pivots around the support member and to dampen the force on the pivot sleeve. The axis of rotation is defined by the stationary support member and is therefore fixed. Motion of the target is limited to pivoting. U.S. 4,662,630 to Dignard et al. discloses a martial arts striking apparatus which holds a striking board to an upright support. The board is attached pivotably so that it may be kicked from the front or from underneath.

It also employs springs whih aid in allowing the board to pivot in response to a blow and return to its previously set position. However, Dignard's target motion is very undefined, due to the particular mounting on an unencumbered spring member.

There is no known striking apparatus which holds a non-breakable, reusable target in a resilient joint defining a preferred but displaceable pivot axis when struck, and includes changeable damper bands to provide variable impact resistance. The prior art shows no striking apparatus which, by a resilient joint, allows a striking surface to be held safely in close proximity to a support post, yet which allows for follow-through by the kicker attempting to strike through the surface. There is also no known striking apparatus which is readily adaptable for attachment to previously owned exercise equipment.

SUMMARY OF THE DISCLOSURE

The aforementioned prior art objects are achieved by the striking apparatus of this invention which provides a resilient joint between a target (i.e., impact receiving member) and a support. The resilient joint comprises a hinge member which includes two connected, resilient hinge leaves, a distal one of which is fixed to the target, while the proximal one is fixed to a support. Means attach each hinge leaf to the other hinge leaf and resiliently mount the strike receiving member, i.e., target, to the support by attachment at opposing hinge ends. The hinge member can be a two thickness hard rubber panel with bolts or the like passing therethrough. A set of stiffeners is located transverse each hinge leaf proximate a longitudinal midpoint of the hinge to serve as means to define the preferential hinge axis. The stiffeners allow the hinge to flex at the axis but resist twisting and lateral s-shaped displacement of the hinge which might be caused by the force of the strike or kick as the user strikes through the plane of the target panel.

Optional damper bands may be positioned on opposing posts extending outwardly from the support or base section and the strike receiving target panel. The posts are located on both sides of both the target and base section, preferably within an inch or so of the facing ends of those members. The dampers are preferably doughnut shaped or elongated bands with rounded ends, defining one or more apertures which overfit the posts and resist pivoting around the axis due to their resistance against stretching. The dampers are changeable, being supplied in sets with varying spring constants (i.e. resistance to stretching), and the degree of resistance is chosen according to the skill and strength of the user. Soloflex brand weight straps may be used as the dampers and come in weight resistance ranges, for example, of 5 lb, 10 lb, 15 lb, 25 lb, 50 lb, etc. These may be added on top of one another in use. The straps may be stretched from adjacent post to post, spaced transverse of the hinge leaf, over the length of the hinge leaf, or diagonally across the stiffener on the hinge member. Optional self-fastening straps may be used to hold the dampers to the apparatus, and/or to protect the use from striking the damper posts.

The target is preferably a polypropylene board about a quarter inch thick to one inch thick, the target preferably being at leastone inch in thickness when covered with a canvas cover and dense foam padding on each side.

The base section is adapted to be received by a bracket which may be fastened to a wall support by a pin arrangement or may be received in an extending tube of a bracket which attaches to the vertical post of pre-existing exercise equipment.

It is, therefore, an object of this invention to provide a striking apparatus with a target panel connected to a fixed support by means of a resilient joint which resists twisting of an impact receiving member during use but which allows for follow-through by the user.

It is another object of this invention to provide a striking apparatus with a resilient joint and variable resistance provided by quickly changeable dampers.

It is yet another object of this invention to provide a striking apparatus which is readily adaptable to standardized equipment such as the Soloflex-type exercise system and which is attachable to the Soloflex-type support.

A further object of the invention is to provide a hand held portable industrial strength training device which can withstand extensive heavy use.

Yet another object of the invention is to provide a target mounted at a safe clearance from a vertical support post.

Another object of the invention is to privide a training tool that is equally challenging to the beginner and the advanced athlete.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

BRIEF DESCRIPTION OF THE DRAWING(S)

FIG. 1 is a perspective view of the striking apparatus of this invention, shown without the damper bands.

FIG. 2 is an enlarged perspective view of the hinge member of the striking apparatus.

FIG. 3 is a cross section, taken on lines 3—3 of FIG. 2, to further illustrate the attachment of hinge leaves.

FIG. 4*a* is a top plan view of a damper band.

FIG. 4*b* and 4*c* are perspective views of alternative damper bands (FIG. 4*c*'s being a resiliently flexing rod).

FIG. 5 illustrates a bracket for attaching the striking apparatus to a vertical support post.

FIG. 6 is a perspective view of the assembled device, with the dampers and cover in palce.

FIGS. 7*a–c* are diagrams illustrating the degrees of freedom of the hinge according to the invention, including twist (FIG. 7*a*), pivoting (7*b*) and lateral displacement (7*c*).

FIG. 8 is an elevation view of an alternative embodiment using a post-engaging hinge member and mounted on a spined type supporting post.

DETAILED DESCRIPTION OF THE PREFERRED EMBODIMENT(S)

Referring now to the drawings, and more particularly to FIG. 1, martial arts apparatus 10 has base 14, hinge 16 and target 12. The striking apparatus 10 is supported, for example, on a wall or a support post 11, i.e. a vertical post. Striking apparatus 10 is especially suited to be used as part of a multi-element standardized exercise device such as the Soloflex system, which includes a post with a plurality of pin receiving apertures in a spine-like flange on a post, for mounting the device at a desired height. The device can also be attached to a post via holes running through the post at intervals (see FIG. 6). A position on the post is selected and bracket 34 fixed thereto by a pin. The pin can be through whichever pair of holes 35 (see FIG. 5) match with holes in the post. Support arm 21 is fixed to bracket 34 via pin 19 inserted through support arm 21 at the aperture end 36 of bracket 34. Pin 19 sets the target at any of a plurality of angles defined by aligning angularly spaced holes in end 36 and arm 21 respectively. The pins can be threaded bolts, locked by tightening of nuts (e.g., nut 31 on bolt 19). Striking apparatus 10 is particularly useful for practice of kicking and it is important that it be adjustably positionable for height of the user and for the type of kick being practiced. Thus, a post or support which allows variable positioning and an angular adjustment are recommended. Support arm 21 is preferably heavy tubular steel which will withstand force and not wobble or bend with the force of the strikes on apparatus 10. Base 14 is a durable metal or plastic attached to hinge member 18 with bolts 27 (which are more fully described in reference to FIG. 2. Support arm 21 and base 14 can be welded together or can be an integrally molded body. For reinforcement purposes, plastic spacing plates 15 and 17 can be provided to thicken the base panel 14 and target panel 12, especially adjacent the posts for the resilient dampers, in the area between hinge 18 and base 14 or target panel 12, respectively. A spacer 23 can also be placed between hinge leaf parts 18 such that they extend more parallel rather than converging at stiffener 24 (see FIG. 7*a*).

Target 12, with preferably padded striking surface 13, is preferably a polypropylene board with rounded edges for safety purposes. The larger the size of the target 12 the greater the safety of the apparatus since the kick will be aimed at a point relatively farther from the support portion 14 and the hinge 16. For maximum effectiveness of hinge 16, it is also preferred that target 12 be spaced apart from base 14 by about four inches and that the bolts attaching target 12 to hinge 16 be about one inch from the facing edges of target 12 and base 14. Reinforcement plate 17 may be added to target 12 to thicken it at the posts 22*c*,22*d* or the polypropylene board itself may be formed with additional thickness at the attachment end. Target 12 may be padded, for example, with urethane foam, and covered with canvas for both safety purposes and comfort of the user.

Posts 22*a*, 22*b*, 22*c* and 22*d* (referred to collectively as posts 22) are found on both the fronts and the backs of base 14 and target 12, respectively. The posts 22 are rigidly fixed to or integral with their respective base members and are preferably about three inches high. Each post may be capped by a plastic nub for additional protection of the user. Each post is spaced about one inch from the edge of its respective base and six inches from the other post on that base. The target and the base are four inches apart so the opposing posts on target and base are also six inches apart. This spacing allows dampener bands 30 (described in reference to FIG. 4) to be placed as desired in several different directions across posts 22.

Resilient hinge 16, as illustrated in FIGS. 1, 2 and 3, has a pair of coextensive flexible hinge leaves 18 which are identical $\frac{3}{8}$ inch thick rubber plates. Each hinge leaf 18 is rounded and is fastened to the opposite leaf and to either the target 12 or base 14 by nuts 26 and bolts 27. It is preferred that washers 28 be added so that the heads of bolts 27 do not pull through the rubber after long use of the apparatus. It is also preferred that nuts 26 be toothed on their face directed toward hinge parts 18, and used with flush bolts, so that they do not work loose when the striking apparatus is in use. Flat headed bolts may be used and countersunk. Attached across each hinge leaf 18 at its longitudinal midpoint is a central stiffener 24 which defines the preferential hinge axis and resists extensive twisting of the hinge leaves 18. Stiffeners 24 are preferably half-inch thick plastic bars attached through both hinge leaves to each other by countersunk bolts 30. Stiffeners 24 resist twisting of the hinge in the form of flexing (as shown in FIG. 7*a*), yet allow some lateral displacement (FIG. 7*c*) together with pivoting (FIG. 7*b*). It is important the the user be able to follow through with his arm, leg, hand, elbow, foot, et. when he strikes the target, and therefore, some displacement of the target is necessary. However, it is obvious that the displacement must be controlled, or the target will be too stiff under the blow, the energy of which would otherwise come back towards the kicker, causing possible injury. As a user becomes stronger and more skilled, additional stiffness, i.e., resistance to pivoting and displacement, is provided by placing more and/or heavier variable resistance damper bands 32 onto the apparatus 10. Hinge 16 allows for six-way freedom of target 12 in relation to base 14. The hinge axis defined by stiffeners 24 provides for conventional hinge action which would be seen in the target moving directly away from the user and then back again. In that case, the bands 32 on the side facing the kicker resist by stretching. Target 12 may also twist as it turns, the degree of twist determined by the force of the strike and use of a hinge support bar 24, which tends to prevent twisting by stiffening hinge 16 parallel to the usual pivot axis. Additional dampener bands primarily resist pivoting because the damper bands are not individually stretched in twist or displacement, these motions being resisted primarily by hinge leaves 18. Parallelogram deflection (FIG. 7*c*) is also reduced by stiffeners 24. The hinge axis remains along the stiffener, but the target moves forward parallel to the base rather than swiveling around it. Stiffener 24 is preferably at the midpoint between sections 12,14, but can also be closer to one or the other to vary the overall resilience of the joint.

Stiffener 24 can be a two-part element connected outside snug-fitting hinge leaves 18 as in FIG. 2, or can be defined by more widely separated leaves 18 as in FIGS. 7*a*–7*c*. FIG. 7*a* shows an embodiment wherein the leaves 18 are separated by a pin 23, also tending to define the hinge axis. A connecting member such as a bolt can extend between the two stiffener semi-cylindrical parts 24. FIG. 8 shows an alternative embodiment wherein hinge leaf parts 18 are wide enough to encompass posts 22, as above, stiffeners 24 define a preferential hinge axis to reduce the tendency of the hinge member to twist. Attachment to posts 22 can be the sole means for fixing together the parts.

Damper bands 32, as illustrated in FIGS. 4*a* and 4*b*, are either doughnut shaped rings or elongated, generally "dog-bone" shaped rubber plates. Each band 32 includes apertures 33 for posts 22, which are about six inches apart at rest. A damper band 32 is placed over two posts 22 on the base 14 and target 12, respectively. Bands 32 may be placed (referring to FIG. 1) one over posts 22*a* and 22*c*, and one over posts 22*b* and 22*d*, spanning the preferred four inch space between the base 14 and target 12. This placement provides added resistance to pivoting only. Bands 32 may be placed one over posts 22*a* and 22*b*, and one over posts 22*c* and 22*d* for storage, spanning hinge 16 on each side of the apparatus and not providing added resistance. Bands 32 can also be criss-crossed (posts 22*a* to 22*d* and 22*b* to 22*c*) for resistance to pivoting and twisting. It is preferred that dampener bands 32 be used in sets on both sides of the apparatus, thus, a minimum of four bands 32 are used in each application. The bands 32 are supplied in comparable weight resistance sets, for example 5 lb., 10 lb., 25 lb. and 50 lb. spring constants (pounds per inch of extension). These may be used individually or in any combinations. If desired, longer bands 32 may be supplied to stretch diagonally from, for example, post 22*a* to post 22*d*. Comparable resilience ranges can be achieved using O-ring bands (FIG. 4*b*) or resilient rods (FIG. 4*c*). The resilient rods can be mounted offset from the axes of posts 22, as shown in FIG. 4*c*, allowing aditional diversity by choice of placement of the rods between posts 22*a* and 22*b*, or outside them, or both.

FIG. 5 illustrates a preferred attachment means for supporting the striking apparatus on a vertical support post. Bracket 34 includes extending tube 36 which slidably receives support arm 21 (seen in FIG. 1). Bracket 34 and the tube section extending therefrom can be welded together, or can be an integral molded body. Bracket 34 slides on a support post which includes a plurality of apertures either through the post (FIG. 6) or through a spine running along the post (FIG. 8) as in a Solofelx-type device. When a desired height for the striking apparatus is determined, the user places a pin through apertures 35 and the apertures in support arm 21, holding the striking apparatus at the predetermined height. The pin used may be a bolt and nut arrangement, or an L-shaped pin may be used to lock the apparatus in position. Since it is desirable to change the angle of the striking target 12 for practicing different strikes, arm 21 is rotatable within the support post and may be held at several points in its rotation, for example positioning the target parallel to the ground, perpendicular to the ground, or at a 45° angle to the ground.

Bracket 34 has a space 37 between its ends opposite end 36. This space allows bracket 34 to pass bolts holding a mounting post (see FIG. 6) to a wall or the like. Extending tube 36, or an additional extension part (not shown) between tube 36 and support arm 21 can be either straight or bent, as desired to appropriatedly position the target 12 for a given exercise.

There are several variations which can be practiced in the scope of this invention. Chiefly, the striking apparatus may be used with a support post of the user's choice or it may be used with the Soloflex system. The user may choose to vary the resistance by adding damper bands in different positions and in different weights of resistance. Preferably a Velcro-attachable cover or belt can be wrapped around the hinge area to prevent loss of dampers 32 and to minimize injury to the user should a kick fall too close to posts 22.

A striking apparatus 10 has a hinge member 16 defining a resilient joint between blow-receiving target 12 and a stationary support. Two identical, resilient hinge leaves 18 have generally rounded ends. Each hinge leaf is attached to the other in parallel juxtaposition to form a hinge 16 with two pairs of ends. Means 26,27 and 28 retain planar objects between the pairs of ends of hinge leaves 18. An elongated central stiffener 24 is attached to hinge leaves 18 by means 30 at a midpoint of hinge leaves 18. A generally planar base section 14 is retained between one pair of ends 20 of hinge leaves 18 and a blow-receiving target 12 is retained between the other ends of hinge leaves 18. There are bracket means 34 for attaching a support arm 21 to a stationary support. A set of posts 22 extends outwardly from the planar surfaces of the target 12 and base member 14 proximate their facing edges for receiving damper bands. The posts may include caps 25 on their exposed ends. The damper bands 32 are either doughnut shaped or elongated and include apertures 33 for overfitting the posts 22. The stiffener 24 includes two semi-cylindrical bars bolted together through the hinge leaves 18. The target and the base include thickened portions proximate the posts 22. The target may include protective padding and straps may be provided to hold the damper bands 32 on the apparatus during use. Target panel 12 can be ribbed for better durability and safety at light weight.

Having now illustrated and described my invention, it is not intended that such description limit this invention, but rather that this invention be limited only by reasonable interpretation of the appended claims.

What is claimed is:

1. A striking apparatus with a resilient joint, comprising:

(a) a hinge member defining a resilient joint between a blow-receiving target and a stationary support, said hinge member including:

(i) two identical, resilient hinge leaves having generally rounded ends;

(ii) means to attach each said hinge leaf to the other in generally parallel juxtaposition to form a hinge with two pairs of ends, the hinge defining a perferential hinge axis;

(iii) means to retain planar objects between the pairs of ends of said hinge leaves;

(b) a generally planar base section, retained between one pair of ends of said hinge leaves, the blow receiving target being retained between the other pair of ends of said hinge leaves, opposite said base section;

(c) a support arm at one end of said base section;

(d) means for attaching the support arm to said stationary support.

(e) a plurality of extending posts located on the planar surfaces of the blow-receiving target and the base section proximate said hinge leaves, for receiving damper bands operable to restrict movement of said hinge means around said hinge axis.

2. The striking apparatus according to claim 1 wherein said posts include caps on their exposed ends.

3. The striking apparatus according to claim 1, further comprising a plurality of resilient damper bands attachable to said posts.

4. The striking apparatus according to claim 1, wherein said resilient hinge leaves are rubber.

5. The striking apparatus according to claim 1, further comprises a central stiffener for fixing said preferential hinge axis, said central stiffener having two semi-cylindrical bars bolted together through the hinge leaves.

6. The striking apparatus according to claim 1, wherein said hinge leaves are attached directly to each other and to said base and said strike receiving member by bolts, washers and toothed nuts.

7. The striking apparatus according to claim 1, wherein each of said blow-receiving target and said base has a thickened portion proximate the posts.

8. The striking apparatus according to claim 1, further comprising protective padding on a surface of said blow-receiving target.

9. The striking apparatus according to claim 3, further comprising a plurality of damper bands of different resistances, removably affixable to the posts.

* * * * *